US011600478B2

(12) United States Patent
Yacout et al.

(10) Patent No.: US 11,600,478 B2
(45) Date of Patent: Mar. 7, 2023

(54) THERMIONIC CONVERTER AND METHODS OF MAKING AND USING SAME

(71) Applicant: UCHICAGO ARGONNE, LLC, Chicago, IL (US)

(72) Inventors: Abdellatif M. Yacout, Naperville, IL (US); Sumit Bhattacharya, Darien, IL (US)

(73) Assignee: UCHICAGO ARGONNE, LLC, Chicago, IL (US)

( * ) Notice: Subject to any disclaimer, the term of this patent is extended or adjusted under 35 U.S.C. 154(b) by 269 days.

(21) Appl. No.: 16/783,105

(22) Filed: Feb. 5, 2020

(65) Prior Publication Data

US 2021/0242003 A1 Aug. 5, 2021

(51) Int. Cl.
*H01J 45/00* (2006.01)

(52) U.S. Cl.
CPC ..... *H01J 45/00* (2013.01)

(58) Field of Classification Search
None
See application file for complete search history.

(56) References Cited

U.S. PATENT DOCUMENTS 6,250,984 B1 6/2001 Jin et al.
6,509,669 B1 1/2003 King et al.
6,619,044 B2 9/2003 Batchelor et al.
7,699,668 B2 4/2010 Lendi
9,607,815 B2 3/2017 Lee et al.
2002/0175408 A1 11/2002 Majumdar et al.
2016/0300684 A1 10/2016 Feigelson et al.
2017/0062195 A1* 3/2017 Hardcastle ..... H01J 45/00
2019/0371582 A1* 12/2019 Clark ..... H01J 45/00
2020/0208276 A1* 7/2020 Lee ..... C25B 1/04
2021/0094015 A1 4/2021 Yacout et al.

FOREIGN PATENT DOCUMENTS

WO WO-2014/033690 A2 3/2014

OTHER PUBLICATIONS

G. N. Hatsopoulos et al., "Thermionic Energy Conversion: Processes and Devices", vol. 1. Cambridge, MA, USA: MIT Press, 1973.
W. Schlichter, "Die spontane Elektronenemission glühender Metalle und das gluhelektrische Element," Ann. Phys., vol. 352, No. 13, pp. 573-640, 1915.
G. N. Hatsopoulos, "The thermo-electron engine," Ph.D. dissertation, Dept. Mech. Eng., Massachusetts Inst. Technol., Cambridge, MA, USA, 1965.
He W. (2013) ALD: Atomic Layer Deposition, Precise and Conformal Coating for Better Performance. In: Nee A. (eds) Handbook of Manufacturing Engineering and Technology. Springer, London.

(Continued)

*Primary Examiner* — Ashok Patel
(74) *Attorney, Agent, or Firm* — Marshall, Gerstein & Borun LLP

(57) ABSTRACT

Provided herein are thermionic converters that are capable of operating at lower temperatures and with increased efficiency as compared to conventional thermionic converters. Also provided are methods of using and making the thermionic converters of the disclosure.

10 Claims, 5 Drawing Sheets

(56) References Cited

OTHER PUBLICATIONS

Arthur L. Smith, and Roland Breitwieser, "Richardson-Dushman Equation Monograph", Journal of Applied Physics 41, 436 (1970); doi: 10.1063/1.1658371.
R Ravi Raja Malarvannan, TV Moorthy, S Sathish and P Hariharan, "Investigation on the corrosion behavior of physical vapor deposition coated high speed steel", Advances in Mechanical Engineering 2015, vol. 7(8) 1-5.
W. B. Hall, et al., "The development of a low work function collector for thermionic energy converters", radio corporation of America, 1963.

* cited by examiner

THERMIONIC CONVERTER AND METHODS OF MAKING AND USING SAME

STATEMENT REGARDING FEDERAL SPONSORED RESEARCH OR DEVELOPMENT

This invention was made with government support under grant number DE-AC02-06CH11357 awarded by the United States Department of Energy. The government has certain rights in the invention.

BACKGROUND

Field of the Disclosure

The disclosure generally relates to a thermionic converter and methods of making and using the thermionic converter.

Brief Description of Related Technology

In order to meet growing energy demands and to reduce the dependency on conventional energy resources, alternative yet efficient methods of energy conversion from easily obtained sources of energy are being considered and evaluated. A suitable alternative to the conventional approach can be direct energy conversion (DEC), where heat generated from various industries, such as oil and gas, and power plants, such as nuclear or coal, can be directly and efficiently converted to electricity. As a technology, DEC offers remarkable advantages due to its compactness, high power density, silent non-moving parts operation, long operational lifespan, and clean energy generation. There are two main categories of DEC: thermoelectric conversion and thermionic conversion.

Thermoelectric conversion has an efficiency of about 10-20% and can be used for temperatures at about 100-500° C. Thermoelectric conversion has been useful for low temperature applications. However, thermoelectric conversion has not been proven suitable in the higher temperature range due to its direct electrode contact design, which significantly lowers the conversion efficiency. Therefore, in applications with a higher temperature range, i.e., greater than 500° C., it is an unreliable option.

In contrast, thermionic conversion has a predicted efficiency of about 30-45%, but in practice, efficiencies of only about 7-15% have been achieved. Moreover, in order to generate sufficient current, conventional thermionic converter emitters must be very high—typically much greater than 1000° C. Thus, technical knowledge and applicability of thermionic emission has been limited to use in niche applications in expensive electron-emission devices for imaging and characterization, along with a few limited electronics and sensing devices. As an energy conversion technology, the technical knowledge is at a standstill, and there remains a problem of massive amount of wasted heat in the high temperature (~800° C. and higher) spectrum associated with its use.

SUMMARY

In embodiments, a thermionic converter can include a collector, an emitter, a gap disposed between the collector and the emitter, an electrical connection means connecting the collector and the emitter, and cesium disposed in the gap adjacent the emitter. The emitter can include a cold worked metal substrate capable of emitting electrons when heated to temperatures of 800° C. or greater. The cold worked metal substrate can be cold rolled in the direction of grains of a target crystallographic orientation having the lowest surface energy and highest bare work function. The grains of the target crystallographic orientation can be thermally grown such that the grains of the target crystallographic orientation represent at least 40% of the surface area of the metal substrate. The grains of the target crystallographic orientation can be etched to form a patterned surface, thereby increasing the surface area on a face of the grains.

In embodiments, the emitter and/or collector can include one or more of iron, nickel, thorium, tungsten, niobium, tantalum, iridium, rhenium, molybdenum, mixtures, and alloys thereof. In embodiments, the metal substrate can include tungsten or niobium, and the target grains can have a [110] or [100] crystallographic orientation. In embodiments, the metal substrate can include molybdenum, and the target grains can have a [110] crystallographic orientation.

In embodiments, the collector can have a work function that is less than a work function of the emitter. In embodiments, the emitter can have a work function of about 1.5 eV to about 2.0 eV. In embodiments, the collector can have a work function of about 0.8 eV to about 1.2 eV.

In embodiments, the gap is about 20 μm to about 1500 μm.

In embodiments, the grains of the target crystallographic orientation can represent about 40% to about 50% of the surface of the metal substrate. In embodiments, the grains of the target crystallographic orientation can be electrochemically etched.

In embodiments, the patterned surface can include a surface structure comprised of a plurality of pyramidal structures having a fractal distribution. In embodiments, the patterned surface can include a surface structure comprised of a plurality of hemispherical structures. In embodiments, the patterned surface can include a surface structure comprised of a plurality of single atomic steps.

In embodiments, the surface area on a face of the etched target grains can be at least 2 orders of magnitude greater than the surface area on a face of the heat grown target grains prior to etching. In embodiments, the surface area on a face of the etched target grains can be 2 to 3 orders of magnitude greater than the surface area on a face of the heat grown target grains prior to etching.

In embodiments, the emitter and/or the collector can be free of a thermionic coating. In embodiments, the emitter and/or the collector can be free of a dopant.

In embodiments, a method of converting heat into electricity can include providing the thermionic converter of the disclosure, and exposing the emitter to a heat source. The heat source can have a temperature that is at least 800° C.

In embodiments, a method of making an emitter for a thermionic converter can include heat treating a cold worked metal substrate and etching the heat treated metal substrate by immersing the heat treated metal substrate in an etchant. The cold worked metal substrate can be cold rolled in the direction of grains having a target crystallographic orientation having the lowest surface energy and highest bare work function. The faces of the grains having the target crystallographic orientation can preferentially etch. The cold worked metal substrate can be heat treated under conditions to grow the grains having the target crystallographic orientation while maintaining intrinsic stress in the grains resulting from the cold rolling.

In embodiments, the cold worked metal substrate can be heat treated at a temperature of at least about 800° C. In embodiments, the cold worked metal substrate can be heat treated at a temperature of about 900° C. to about 1200° C.

In embodiments, the cold worked metal substrate can be heat treated for about 1 hour to about 15 hours.

In embodiments, the etchant can include methanol, oxalic acid, hydrogen peroxide, perchloric acid, sulfuric acid, hydrofluoric acid, ammonium hydroxide, hydrochloric acid, formic acid, or any combination thereof. In embodiments, the etchant can include methanol and at least one of oxalic acid, perchloric acid, sulfuric acid, hydrofluoric acid, hydrochloric acid, or formic acid.

In embodiments, the heat treated metal substrate can be etched at a temperature of at least about 40° C. In embodiments, the heat treated metal substrate can be etched at a temperature of about 40° C. to about 70° C. In embodiments, the heat treated metal substrate can be etched at an etching voltage of about 0.1 V to about 30 V. In embodiments, the heat treated metal substrate can be immersed in the etchant for about 10 minutes to about 45 minutes.

In embodiments, the method can further include immersing the cold worked metal substrate in a first cleaning solution prior to heat treating the metal substrate. In embodiments, the method can further include immersing the heat treated metal substrate in a second cleaning solution prior to immersing in the etchant. In embodiments, the first cleaning solution and/or second cleaning solution can include NaOH, KOH, or a mixture thereof. In embodiments, the first cleaning solution and/or the second cleaning solution can have a temperature of about 30° C. to about 70° C. In embodiments, the cold worked metal substrate can be immersed in the first cleaning solution for about 1 minute to about 10 minutes. In embodiments, the cold worked metal substrate can be immersed in the first cleaning solution at a voltage of about 0.1 V to about 30 V. In embodiments, the heat treated metal substrate can be immersed in the second cleaning solution for about 1 minute to about 10 minutes. In embodiments, the heat treated metal substrate can be immersed in the second cleaning solution at a voltage of about 0.1 V to about 30 V.

In embodiments, the surface area of the metal substrate can be increased by at least 2 orders of magnitude. In embodiments, the surface area of the metal substrate can be increased by 2 to 3 orders of magnitude.

Further aspects and advantages of the disclosure will be apparent to those of ordinary skill in the art from a review of the following detailed description. While the compositions and methods are susceptible of embodiments in various forms, the description is illustrative and is not intended to limit the scope of the disclosure to the specific embodiments described herein.

DETAILED DESCRIPTION

In accordance with embodiments, the disclosure provides a thermionic converter including a collector and an emitter separated by a gap, but electrically connected. The thermionic converter includes cesium disposed in the gap adjacent the emitter.

Figure 1:
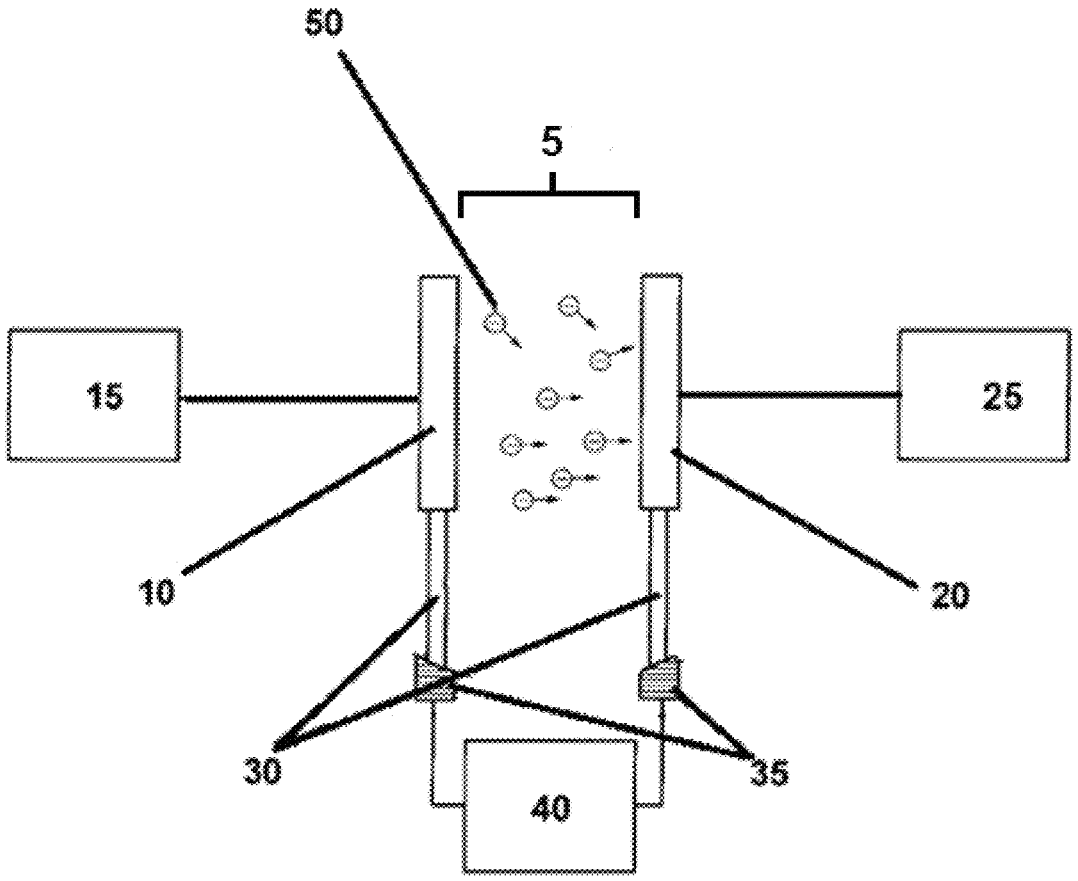
FIG. 1 PRIOR ART
FIG. 1 is a schematic illustration of a conventional thermionic converter.

FIG. 1 illustrates the components and processes of a conventional thermionic converter employing technology understood and applied prior to the present invention. The thermionic converters of the disclosure are generally structured and function in the same way as conventional thermionic converters, but have improved efficiency and ability to operate at lower temperatures through improved emitter surface structures. In accordance with FIG. 1, a heat source 15 elevates the temperature of the emitter 10. Electrons 50 are then thermally evaporated into a gap 5 disposed between the emitter 10 and the collector 20. Disposed within the gap 5, adjacent the emitter 10 is cesium (e.g., cesium vapor). The collector 20 is cooled by a heat sink 25 and kept at a low temperature. The electrons 50 travel across the gap 5 and condense on the collector electrode 20. The electrons 50 then return to the emitter electrode 10 through the electrical connection means (e.g., electrical leads 30, electrical terminals 35, load 40, etc.) connecting the collector 20 and the emitter 10.

Conventional thermionic converters were first used in the 1950*s* for space applications. These converters, however, only operated at temperatures of over 1600° C., and had efficiencies of only about 7% to 11%. Contemporary thermionic converters, which have been applied to nuclear heat sources, only have efficiencies of about 20%. Advantageously, the thermionic converter of the disclosure includes an emitter that has a lower work function as compared to conventional emitters. The lower work function of the emitter allows the thermionic converter of the disclosure to operate at lower temperatures as compared to conventional thermionic converters, and therefore, increases the efficiency of the conversion of heat to electricity by capturing heat that was previously unable to be captured and converted. Moreover, the efficiency of the thermionic converters, at both low and high temperatures, is significantly improved as compared to conventional thermionic converters. Without intending to be bound by theory, it is believed that the patterned surface of the emitter not only results in the absorption of more heat, but also minimizes the amount of heat lost to the surrounding environment. This results in higher efficiency of the thermionic converter, as more of the absorbed heat can be used directly to emit electrons from the emitter. The emitters in the thermionic converters according to the disclosure can have an emission current that is at least about 2, about 2.3, about 2.5, about 2.8 or about 3.0 times greater than that of conventional emitters. This increase in emission current correlates to an increased efficiency of about 30% to about 40%, as compared to the typical 7% to 15% efficiency of conventional thermionic converters.

It has been advantageously found that the process of forming the emitter in accordance with the disclosure, including cold working, grain growth, and etching, can decrease the temperature at which the thermionic converter can operate. Typically, without etching, the thermionic converter would only operate effectively at temperatures greater than about 1500° C. In contrast, the thermionic converter having the etched, heat treated metal substrate can operate at temperatures as low as about 800° C.

Thermionic Converter

In accordance with embodiments, the thermionic converter of the disclosure includes a collector and an emitter. There is a gap disposed between the collector and the emitter. The thermionic converter further includes electrical connection means connecting the collector and the emitter.

Collector, Gap, and Electrical Connection Means

The collector of the thermionic converter includes a metal substrate. Any suitable metal can be used for the collector so long as it is capable of withstanding the desired operating temperatures of the thermionic converter. For example, the collector includes a metal having a melting point sufficiently high to allow it to be subjected to operating temperatures of at least 800° C., 900° C., 1000° C., 1200° C., or 1500° C. without melting or otherwise compromising the structure of the collector. In embodiments, the collector can be tungsten, niobium, tantalum, molybdenum, iron, nickel, thorium, iridium, rhenium, or mixtures thereof, or combinations thereof. In embodiments, the collector can be an alloy including any one or more of the aforementioned metals.

The collector has a work function that is less than a work function of the emitter. In embodiments, the collector has a work function of at least about 0.8, 0.9, 1.0, or 1.1 eV and/or up to about 1.2, 1.1, 1.0, or 0.9 eV. For example, in embodiments, the collector has a work function of about 0.8 eV to about 1.2 eV.

In accordance with embodiments, the collector can be free of a thermionic coating. As used herein, "free of a thermionic coating" means that the collector (or emitter) is not intentionally coated with any material or compound. For example, the collector can be free of a coating including scandium, barium, and the like. In embodiments, the collector can be free of a dopant. As used herein, "free of a dopant" means that the collector (or emitter) is not doped with any material or compound. For example, the collector can be free of doping with sodium, lithium, magnesium, and the like.

In accordance with embodiments, the thermionic converter includes a gap disposed between the collector and the emitter. In embodiments, the gap is at least about 20, 40, 50, 80, 100, 200, 300, 400, 500, 600, 700, 800, or 900 μm and/or up to about 1500, 1400, 1300, 1200, 1100, 1000, 900, 800, 700, or 600 μm, for example, about 20 μm to about 1500 μm, or about 100 μm to about 1500 μm.

In accordance with embodiments, the thermionic converter includes an electrical connection means connecting the collector and the emitter. Electrical connection means can include, for example, electrical leads, electrical terminals, electrical load, and the like.

Emitter

In accordance with embodiments, the thermionic converter includes an emitter. The emitter is capable of emitting electrons when heated. For example, the emitter is capable of emitting electrons when heated to temperatures of at least about 800° C., about 900° C., about 1000° C., about 1200° C., about 1400° C., about 1500° C., about 1600° C., about 1800° C., or about 2000° C.

The emitter is a cold worked metal substrate which has been modified by etching as described herein to have significantly increase surface area. Any suitable metal can be used and can be selected based on the desired operating temperatures, such that the metal is capable of operating at the desired operating temperatures for a desired amount of time without melting or otherwise compromising the structure of the metal or metal substrate. For example, the emitter can include tungsten, niobium, tantalum, molybdenum, iron, nickel, thorium, iridium, rhenium, or a mixture thereof. In embodiments, the emitter includes a metal substrate including tungsten. In embodiments, the emitter includes a metal substrate including niobium. In embodiments, the emitter includes a metal substrate including molybdenum. In embodiments, the emitter can be an alloy including any one or more of the aforementioned metals.

The metal substrate includes grains having a target crystallographic orientation. In embodiments, the target grains have a [110] or [100] type crystallographic orientation. Examples of [110] type crystallographic orientations include, for example, <110>, <101>, and <011> orientations. Examples of [100] type crystallographic orientations include, for example, <100>, <101>, and <001> orientations. In embodiments, the metal substrate is tungsten or niobium, and the target grains have a [110] or [100] type crystallographic orientation. In embodiments, the metal substrate is molybdenum, and the target grains have a [110] crystallographic orientation.

The grains of the target crystallographic orientation are thermally grown (i.e., via the heat treatment), as described herein, such that the grains of the target crystallographic orientation represent at least 40% of the surface area of the metal substrate. For example, the grains of the target crystallographic orientation can represent at least about 40%, 42%, 45% or 47%, and/or up to about 50%, 47%, 45% or 42% of the surface area of the metal substrate. In embodiments, the grains of the target crystallographic orientation represent from about 40% to about 45%, or about 40% to about 50% of the surface area of the metal substrate.

The metal substrate is further etched (e.g., chemically etched and/or electrochemically etched), as described herein, to increase the surface area on a face of the target grain. For example, the surface area on a face of the etched target grains can be at least about 2, 3, 4, or 5 and/or up to about 7, 6, 5, 4, or 3 orders of magnitude greater than the surface area on a face of the heat grown target grains prior to etching. In embodiments, the surface area on a face of the etched target grains is at least about 2 orders of magnitude greater than the surface area on a face of the heat grown target grains prior to etching. In embodiments, the surface area on a face of the etched target grains is 2 to 3 orders of magnitude greater than the surface area on a face of the heat grown target grains prior to etching.

The increased surface area of the metal substrate is largely due to a patterned surface that develops on the surface of the metal substrate as a result of the etching. In embodiments, the metal substrate has a patterned surface that is comprised of a plurality of pyramidal structures having a fractal distribution. In embodiments, the patterned surface is comprised of a plurality of hemispherical structures. In embodiments, the patterned surface is comprised of a plurality of single atomic steps. Additional patterned structures can include, for example, square pyramidal structures, pyramidal structures without fractal distribution, and dendritic surfaces.

As described herein, thermionic converters rely on the emitter having a higher work function that that of the collector. The emitter for a thermionic converter can be designed through the methods described herein to have a work function that is greater than that of the collector, allowing for greater combination of emitter and collector materials to be utilized. In embodiments, the emitter has a work function of at least about 1.5, 1.6, 1.7, or 1.8 eV and/or up to about 2.0, 1.9, 1.8, or 1.7 eV, for example about 1.5 eV to about 2.0 eV.

In embodiments, the emitter can be free of a thermionic coating. For example, the emitter can be free of a coating including scandium, barium, and the like. In embodiments, the emitter can be free of a dopant. For example, the emitter can be free of doping with sodium, lithium, magnesium, and the like.

Methods of Making the Emitter

The disclosure further provides methods of making the emitter as described herein.

The metal substrate can be cold worked at any temperature below the recrystallization temperature of the metal(s) in the metal substrate. Generally, the metal substrate can be cold rolled at ambient room temperature. In embodiments, the metal substrate is cold worked by cold rolling in the direction of grains having a target crystallographic orientation.

For use as the emitter, metal substrates are cold worked in the direction of grains having a target crystallographic orientation. Cold working the metal substrate increases the intrinsic stress of the metal substrate, which is maintained throughout subsequent treatment of the metal substrate. The grains having the target crystallographic orientation have the lowest surface energy of all grains of the metal substrate. Such a target crystallographic orientation has the highest bare work function. As used herein, the term "highest bare work function" means that the grains having the target crystallographic orientation can have the highest work function of all the grains of the bare metal substrate, that is, of the metal substrate prior to any subsequent treatment (e.g. cleaning, heat treating, etching, coating, etc.). Without intending to be bound by theory, each of the [111], [110], and [100] type crystallographic orientations have a unique work function, and each is different from the others by about 6%. For example, a bare metal substrate (e.g., tungsten) with [111] oriented grain can have a work function of about 4.39 eV, while a [110] oriented grain can have a work function of about 4.68 eV. Therefore, at the same temperature, the [111] oriented grain, having the lower work function, will emit electrons more easily than the [110] oriented grain. However, when exposed to a cesium vapor, this phenomenon reverses, causing the oriented grains to more easily emit electrons. Accordingly, by increasing the relative surface area of the [110] grains—that is, the grains having the highest bare work function—relative to the amount of other grain orientations, the overall surface work function of the metal substrate can be reduced.

In embodiments, the target grains have a [110] or [100] type crystallographic orientation. Examples of [110] type crystallographic orientations include, for example, <110>, <101>, and <011> orientations. Examples of [100] type crystallographic orientations include, for example, <100>, <101>, and <001> orientations. In embodiments, the metal substrate is tungsten or niobium, and the target grains have a [110] or [100] type crystallographic orientation. In embodiments, the metal substrate is molybdenum, and the target grains have a [110] crystallographic orientation.

After cold working, the metal substrate can be heat treated under conditions to thermally grow the grains having the target crystallographic orientation while maintaining the intrinsic stress in the grains resulting from the cold working. In embodiments, the grains of the target crystallographic orientation are thermally grown (i.e., via the heat treatment) such that the grains of the target crystallographic orientation represent at least 40% of the surface area of the metal substrate. For example, the grains of the target crystallographic orientation can be thermally grown such that those grains represent at least about 40%, 42%, 45% or 47%, and/or up to about 50%, 47%, 45% or 42% of the surface area of the metal substrate. In embodiments, the grains of the target crystallographic orientation are thermally grown such that the grains of the target crystallographic orientation represent from about 40% to about 45%, or about 40% to about 50% of the surface area of the metal substrate.

The heat treatment temperature and duration is selected to ensure that the structure of the emitter does not deform under the high operating temperatures of the thermionic converter, while simultaneously maximizing retention of intrinsic stress in the grains resulting from cold working. Generally, the temperature at with the cold worked metal substrate is heated must be higher than the temperature at which the thermionic converter will operate. That is, if the thermionic converter is anticipated to be used in an application producing heat at a temperature of about 1500° C., the cold worked metal substrate must be heat treated at a temperature greater than 1500° C., for example about 1600° C. or higher. If the cold worked metal substrate is not heat treated at a temperature greater than the operating temperature, then, during operation, the structure of the emitter can be destroyed and efficiency of the thermionic converter can be compromised.

In embodiments, the cold worked metal substrate is heat treated at a temperature of at least about 800° C. For example, the cold worked metal substrate can be heat treated at a temperature of at least about 800, 900, 1000, 1200, 1300, 1400, or 1500° C. and/or up to about 2000, 1900, 1800, 1700, 1600, 1500, 1400, or 1200° C. In embodiments, the cold worked metal substrate is heat treated at a temperature of about 900° C. to about 1200° C.

The cold worked metal substrate is heat treated for an amount of time suitable to grow the grains having the target crystallographic orientation. In embodiments, the cold worked metal substrate is heated for at least about 1, 2, 3, 4, 5, 6, 7, or 8 hours and/or up to about 15, 14, 13, 12, 11, 10, 9, 8, 7, or 6 hours. For example, in embodiments, the cold worked metal substrate is heat treated for about 1 hour to about 15 hours.

Selections of suitable temperatures and durations can be made based on knowledge in the art regarding growth rates of selected metals at a given temperature. In general, heat treating at higher temperatures can be done at shorter durations to achieve the desired growth, while maximizing retained intrinsic stress, while lower temperatures may require increased duration to achieve desired grain growth. For example, a tungsten metal substrate can be heat treated at a temperature of about 1200° C. for about 10 hours.

Optionally, the cold worked metal substrate can be immersed in a first cleaning solution prior to heat treating the metal substrate. Immersion in the first cleaning solution can help prevent oxygen atoms from seeping into the substrate during the heat treatment. The first cleaning solution can include, for example, sodium hydroxide (NaOH) or potassium hydroxide (KOH), or a mixture thereof. In embodiments, the first cleaning solution includes NaOH. In embodiments, the first cleaning solution includes KOH. The first cleaning solution can have a temperature of at least about 30, 35, 40, 45, or 50° C. and/or up to about 70, 65, 60, 55, 50, 45, or 40° C., for example, about 30° C. to about 70° C. In accordance with embodiments, the cold worked metal substrate can be immersed in the first cleaning solution for at least about 1, 2, 3, 4, 5, 6, or 7 minutes and/or up to about 10, 9, 8, 7, 6, 5, or 4 minutes, for example about 1 minute to about 10 minutes, or about 3 minutes to about 8 minutes. The cold worked metal substrate can be immersed in the first cleaning solution with application of a voltage of at least about 0.1, 0.5, 1.0, 5.0, 10, 15, or 20 V and/or up to about 30, 25, 20, 15, 10, or 5.0 V, for example about 0.1 V to about 30 V, or about 5 V to about 15 V.

Optionally, the heat treated metal substrate can be immersed in a second cleaning solution following heat treatment (e.g., prior to etching). Like with the first cleaning solution, immersion in the second cleaning solution can help rid the surface of the heat treated metal substrate of any residual oxygen atoms, and prevent oxygen atoms from seeping into the substrate during the etching. The second cleaning solution can generally be as described for the first cleaning solution. The second cleaning solution can include, for example, sodium hydroxide (NaOH) or potassium hydroxide (KOH), or a mixture thereof. In embodiments, the second cleaning solution includes NaOH. In embodiments, the second cleaning solution includes KOH. The second cleaning solution can have a temperature of at least about 30, 35, 40, 45, or 50° C. and/or up to about 70, 65, 60, 55, 50, 45, or 40° C., for example, about 30° C. to about 70° C. In accordance with embodiments, the heat treated metal substrate can be immersed in the second cleaning solution for at least about 1, 2, 3, 4, 5, 6, or 7 minutes and/or up to about 10, 9, 8, 7, 6, 5, or 4 minutes, for example about 1 minute to about 10 minutes, or about 3 minutes to about 8 minutes. The heat treated metal substrate can be immersed in the second cleaning solution with application of a voltage of at least about 0.1, 0.5, 1.0, 5.0, 10, 15, or 20 V and/or up to about 30, 25, 20, 15, 10, or 5.0 V, for example about 0.1 V to about 30 V, or about 5 V to about 15 V.

In accordance with embodiments, the grains of the target crystallographic orientation, after heat treating (e.g., thermal growth), are etched to form a patterned surface, thereby increasing the surface area on a face of the grains. The faces of the target grains preferentially etch as a result of the etching step. In embodiments, the grains are chemically etched, for example, with an acid, under heat. In embodiments, the grains are electrochemically etched, for examples with an acid, under heat, and with an applied voltage.

The heat treated metal substrate can be etched by immersing the heat treated metal substrate in an etching solution. The etching solution includes at least one etchant, and can further include a buffer or other additive. In embodiments, the etching solution includes only the etchant. In embodiments, the etchant can include methanol, oxalic acid, hydrogen peroxide, perchloric acid, sulfuric acid, hydrofluoric acid, ammonium hydroxide, hydrochloric acid, formic acid, or any combination thereof. Generally, when an acid is used as the etchant, it can be advantageous to include methanol as a buffer. For example, in embodiments, the etching solution includes methanol and at least one of oxalic acid, perchloric acid, sulfuric acid, hydrofluoric acid, hydrochloric acid, or formic acid. Various examples of suitable etchant combinations include, but are not limited to, methanol and oxalic acid; methanol and perchloric acid; methanol and sulfuric acid; methanol and hydrofluoric acid; ammonium hydroxide and hydrogen peroxide; methanol and hydrochloric acid; and methanol and formic acid.

In accordance with embodiments, the etching can be carried out under heat. That is, the etching solution can be heated to and maintained at a temperature of at least about 40° C. during immersion of the heat treated metal substrate in the etching solution. For example, the etching solution can be heated to and maintained at a temperature of at least about 40, 45, 50, 55, or 60° C. and/or up to about 70, 65, 60, 55, or 50° C. during immersion of the heat treated metal substrate in the etching solution. In embodiments, the etching solution is heated to and maintained at a temperature of about 40° C. to about 70° C., or about 40° C. to about 60° C. during immersion of the heat treated metal substrate in the etching solution. The temperature of the etching solution can be particularly selected to help control the rate of etching of the target grains. If the temperature of the etching solution is too high, e.g., above about 70° C., the solution can evaporate, thereby changing the concentration of the etchant in the etching solution, and affecting the rate of the etching.

The etching can further be carried out with an applied voltage. In embodiments, the heat treated metal substrate is immersed in the etching solution with an applied voltage of at least about 0.1 V. For example, the applied voltage can be at least about 0.1, 0.5, 1.0, 2.5, 5.0, 7.5, 10, 12, 15, or 20 V and/or up to about 30, 27.5, 25, 22.5, 20, 17.5, 15, 12.5, or 10 V. In embodiments, the applied voltage is about 0.1 V to about 30 V, or about 0.5 V to about 10 V. Without intending to be bound by theory, it is believed that when the etching voltage is greater than about 30 V, the etchant erodes the surface of the metal substrate and provides no patterned surface.

The etching can be carried out for any period of time suitable to result in the desired patterned surface. As with the heat treatment step, the etchant, the temperature, the duration, and the applied voltage of the etching should be selected such that the etching rate can be controlled and that the patterned surface of the substrate can be maintained. In accordance with embodiments, the heat treated metal substrate can be immersed in the etching solution for at least about 5 minutes. For example, the heat treated metal substrate can be immersed in the etching solution for at least about 5, 6, 7, 8, 9, 10, 15, 20, 25, or 30 minutes and/or up to about 45, 44, 43, 42, 41, 40, 35, 30, 25, or 20 minutes. In embodiments, the heat treated metal substrate is immersed in the etching solution for about 10 minutes to about 45 minutes, or about 5 minutes to about 15 minutes.

Figure 2A:
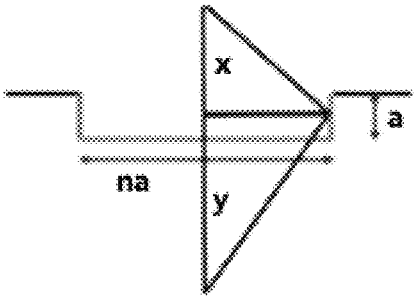
FIG. 2A is a schematic illustration of a single atomic step that can be included in the patterned surface in accordance with embodiments of the disclosure
Figure 2B:
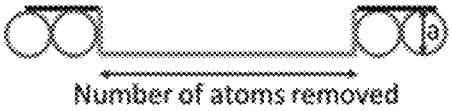
FIG. 2B is a schematic illustration of the single atomic step of FIG. 2A, illustrating the arrangement of atoms around the single atomic step feature.
Figure 2C:
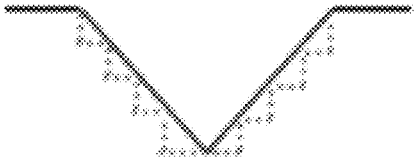
FIG. 2C is a schematic illustration of a pyramidal structure with a fractal distribution that can be included in the patterned surface in accordance with embodiments of the disclosure
Figure 2D:
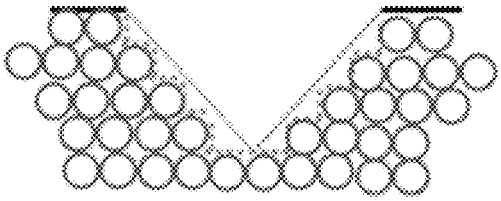
FIG. 2D is a schematic illustration of the pyramidal structure with a fractal distribution of FIG. 2C, illustrating the arrangement of atoms around the pyramidal structure feature.
Figure 2E:
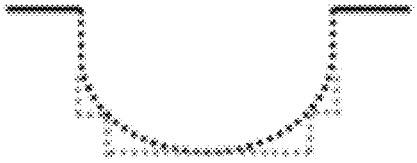
FIG. 2E is a schematic illustration of a hemispherical structure with a fractal distribution that can be included in the patterned surface in accordance with embodiments of the disclosure.
Figure 2F:
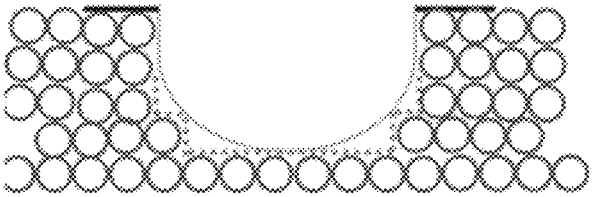
FIG. 2F is a schematic illustration of the hemispherical structure with a fractal distribution of FIG. 2E, illustrating the arrangement of atoms around the hemispherical structure feature.

The etching of the heat treated metal substrate in accordance with the disclosure results in a metal substrate having a patterned surface. The patterned surface can be any pattern that suitably increases the surface area on a face of the grains of the metal substrate, while concurrently lowering the work function of the grains. The patterned surface can include, for example, a plurality of single atomic steps, as shown in FIG. 2A and FIG. 2B, a pyramidal pattern with fractal distribution, as shown in FIG. 2C and FIG. 2D, or a hemispherical pattern with fractal distribution, as shown in FIG. 2E and FIG. 2F. Other patterned surface structures that may be achieved, with or without fractal distribution, include, for example dendritic patterns and square pyramidal patterns. In embodiments, the patterned surface includes a surface structure including a plurality of pyramidal structures having a fractal distribution. In embodiments, the patterned surface includes a surface structure including a plurality of hemispherical structures. In embodiments, the patterned surface includes a surface structure including a plurality of single atomic steps.

It has been advantageously found that selection of etchants, times, temperatures, and/or applied voltages can be used to tailor the resulting pattern. For example, the table below summarizes a few exemplary etching conditions for a tungsten metal substrate that can result in varying patterned surfaces.

| Etchant | Duration (min) | Temperature (° C.) | Voltage (V) | Pattern |
|---|---|---|---|---|
| Oxalic acid | 30 | 60 | 8 | Square Pyramidal |
| Oxalic acid | 15 | 60 | 14 | Dendritic |
| Hydrogen peroxide | 15 | 60 | 5 | Pyramidal (fractal distribution) |
| Hydrogen peroxide | 15 | 60 | 8 | Pyramidal |

As a result of etching, the surface area on a face of the etched target grain is increased. For example, the surface area on a face of the etched target grains is at least about 2, 3, 4, or 5 and/or up to about 7, 6, 5, 4, or 3 orders of magnitude greater than the surface area on a face of the heat grown target grains prior to etching. In embodiments, the surface area on a face of the etched target grains is at least about 2 orders of magnitude greater than the surface area on a face of the heat grown target grains prior to etching. In embodiments, the surface area on a face of the etched target grains is 2 to 3 orders of magnitude greater than the surface area on a face of the heat grown target grains prior to etching.

Thermionic converters rely on the emitter having a higher work function that that of the collector. The emitter for a thermionic converter can be designed through the methods described herein to have a work function that is greater than that of the collector, allowing for greater combination of emitter and collector materials to be utilized. In embodiments, the emitter has a work function of at least about 1.5, 1.6, 1.7, or 1.8 eV and/or up to about 2.0, 1.9, 1.8, or 1.7 eV, for example about 1.5 eV to about 2.0 eV. Advantageously, the emitter of the disclosure, having been cold worked, heat treated, and etched, can have a work function that is about 70% to about 80% less than its work function prior to any cold working, heat treating, or etching.

Methods of Using

In accordance with embodiments, a method of converting heat into electricity includes providing the thermionic converter of the disclosure and exposing the emitter to a heat source. The temperature of the heat source is at least 800° C., for example, at least about 800, 900, 1000, 1200, 1400, 1500, and/or up to about 2000, 1800, 1700, 1600, 1500, 1400, 1200, or 1000° C.

The heat source can be any heat source capable of reaching at least about 800° C. Examples of heat sources include those generated from the oil and gas industries, as well as those generated from nuclear and coal power plants.

It is understood that while the disclosure is read in conjunction with the detailed description thereof, the foregoing description and following examples are intended to illustrate and not limit the scope of the disclosure, which is defined by the scope of the appended claims. Other aspects, advantages, and modifications are within the scope of the following claims.

EXAMPLES

Example 1—Preparation of Tungsten Foil Emitter

Figure 3A:
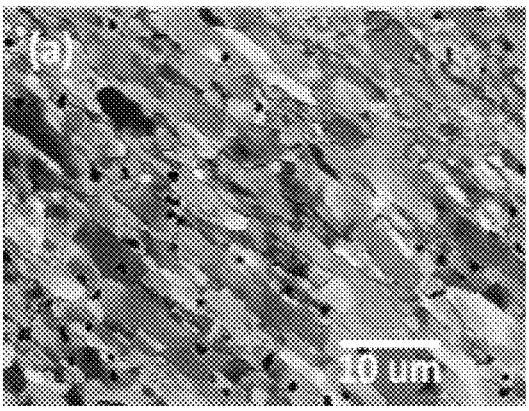
FIG. 3A is an image of the surface of a tungsten foil as received.
Figure 3B:
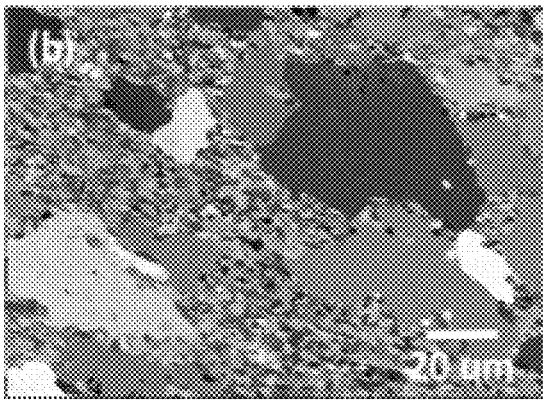
FIG. 3B is an image of the surface of a tungsten foil after a heat treatment at 1000° C. for 2 hours in accordance with embodiments of the disclosure, where the grains of the target crystallographic orientation are of [110] type.
Figure 4:
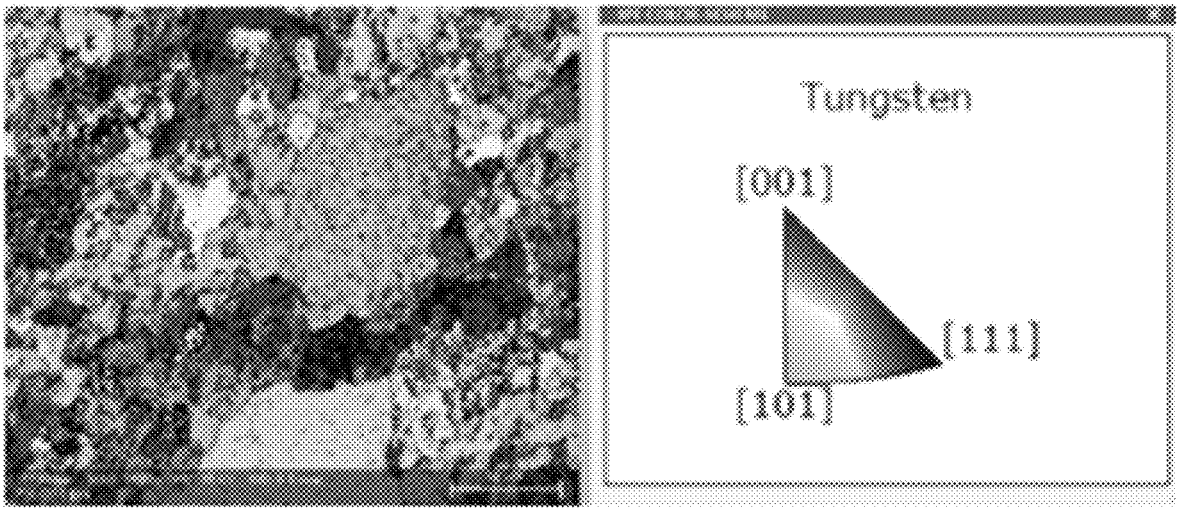
FIG. 4 is an electron backscatter diffraction analysis of a heat treated tungsten foil, in accordance with embodiments of the disclosure, where the grains were grown toward the and [100] type crystallographic orientations.
Figure 5A:
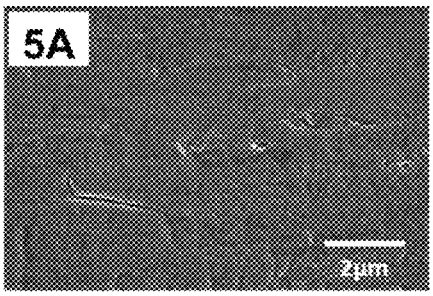
FIG. 5A is an image of the surface of a tungsten foil as received.
Figure 5B:
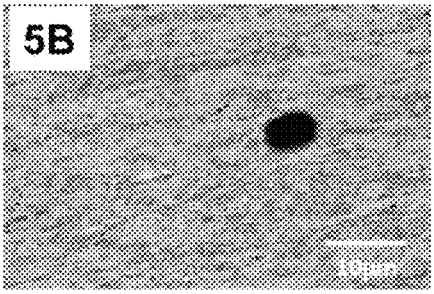
FIG. 5B is an image of the surface of the tungsten foil of FIG. 5A after cleaned with a first cleaning solution in accordance with embodiments of the disclosure.
Figure 5C:
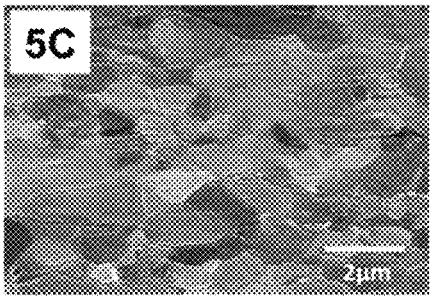
FIG. 5C is an image of the surface of the cleaned tungsten foil of FIG. 5B after heat treated in accordance with embodiments of the disclosure.
Figure 5D:
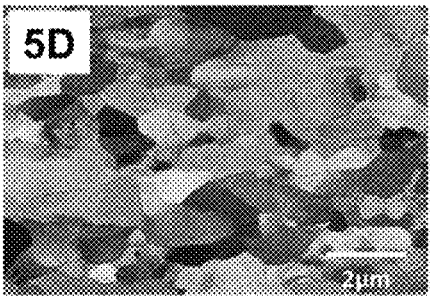
FIG. 5D is an image of the surface of the cleaned, heat treated tungsten foil of FIG. 5C after being cleaned with a second cleaning solution in accordance with embodiments of the disclosure.

A tungsten (W) metal foil, as shown in FIG. 3A and FIG. 5A, was obtained and cold worked by cold rolling along the direction of the preferred grain orientation (here <110>). The cold rolling generated inherent texturing and intrinsic stress in the metal foil. The cold rolled foil was subsequently cleaned with NaOH at 60° C. for 5 minutes at 5 V (DC), as shown in FIG. 5B. The foil was then heat treated at 1200° C. to achieve preferentially coarsened target grains, as can be seen in FIG. 3B (heat treated at 1200° C. for 10 hours) and FIG. 5C (heat treated at 1200° C. for 2 hours). The heat treated foil was then cleaned a second time with NaOH at 60° C. for 5 minutes at 5 V (DC), as shown in FIG. 5D. As shown in FIG. 4, an electron backscatter diffraction analysis of the heat treated foil identified the preferential growth of the grains toward the [110] and [100] type directions.

Figure 6A:
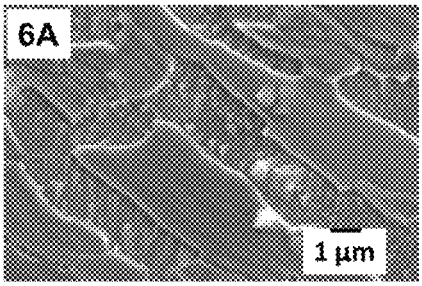
FIG. 6A is an image of the surface of a heat treated tungsten foil after etched with an etchant in accordance with embodiments of the disclosure.
Figure 6B:
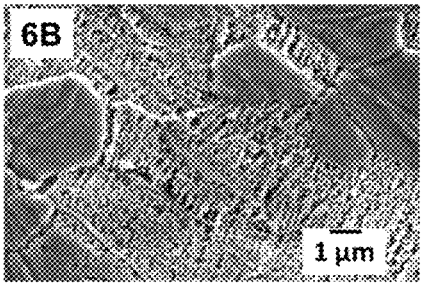
FIG. 6B is an image of the surface of a heat treated tungsten foil after etched with an etchant in accordance with embodiments of the disclosure.
Figure 6C:
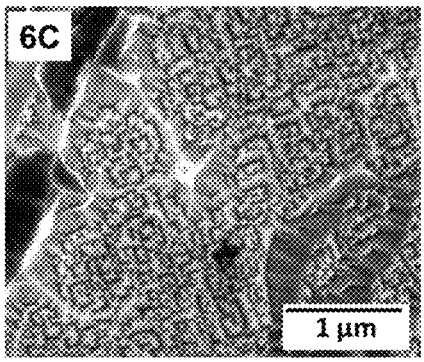
FIG. 6C is an image of the surface of a heat treated tungsten foil after etched with an etchant in accordance with embodiments of the disclosure.
Figure 6D:
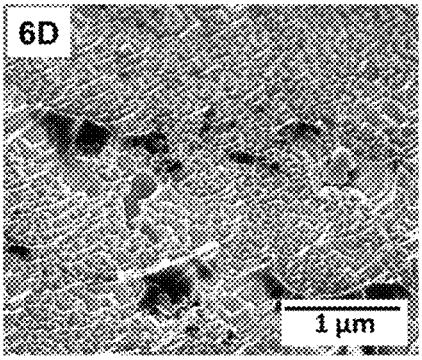
FIG. 6D is an image of the surface of a heat treated tungsten foil after etched with an etchant in accordance with embodiments of the disclosure.

The heat treated and cleaned foil, as shown in FIG. 5D, was then immersed in various etchants in order to increase the surface area of the foil. As shown in FIG. 6A, the foil was immersed in oxalic acid at 60° C. for 30 minutes at 8 V (DC), which provided a square pyramidal patterned surface. This patterned surface did not have a fractal distribution. When the foil was immersed in oxalic acid at 60° C. for 15 minutes at 14 V (DC), the resulting surface had a patterned, dendritic surface, as shown in FIG. 6B. When immersed in hydrogen peroxide at 60° C. for 15 minutes at 5 V (DC), as shown in FIG. 6C, the patterned surface had a fractal, pyramidal structure. Finally, when immersed in hydrogen peroxide at 60° C. for 15 minutes at 8 V (DC), the resulting patterned surface resulted in a pyramidal structure, but did not have a fractal distribution, as shown in FIG. 6D. Although the surface of the foil as shown in FIG. 6D had a high surface area, the work function associated with that patterned surface was not as low as that for the foil having the patterned surface of the foil shown in FIG. 6C. The surface area of the tungsten foil when etched as shown in FIG. 6C increased by 2-3 orders of magnitude as a result of the etching. Advantageously, the fractal pyramidal surface—having a "pyramid within a pyramid" structure—had the lowest work function of all the foils as shown in FIGS. 6A-6D.

Example 2—Performance of Tungsten Foil Emitter

Figure 7A:
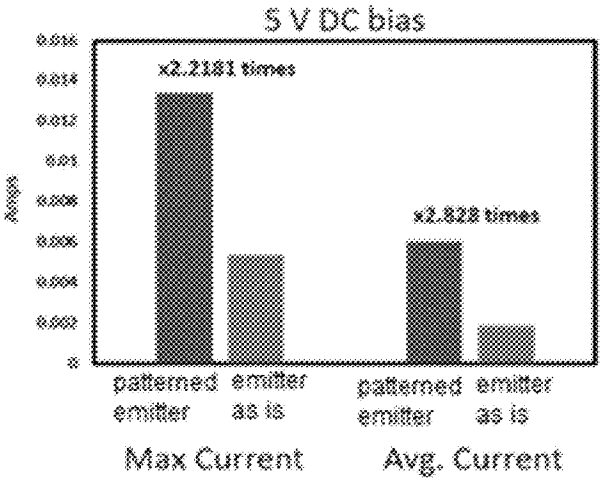
FIG. 7A is a graph comparing the currents emitted by an emitter in accordance with embodiments of the disclosure and an emitter prepared from tungsten foil as received under a 5 V bias.
Figure 7B:
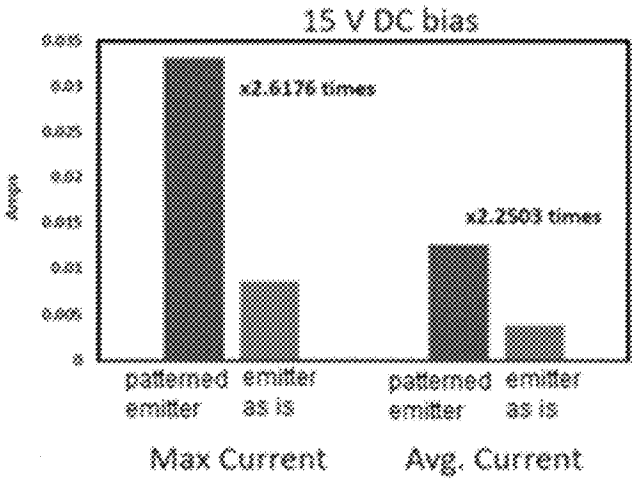
FIG. 7B is a graph of the currents emitted by an emitter in accordance with embodiments of the disclosure and an emitter prepared from tungsten foil as received under a 15 V bias.
Figure 7C:
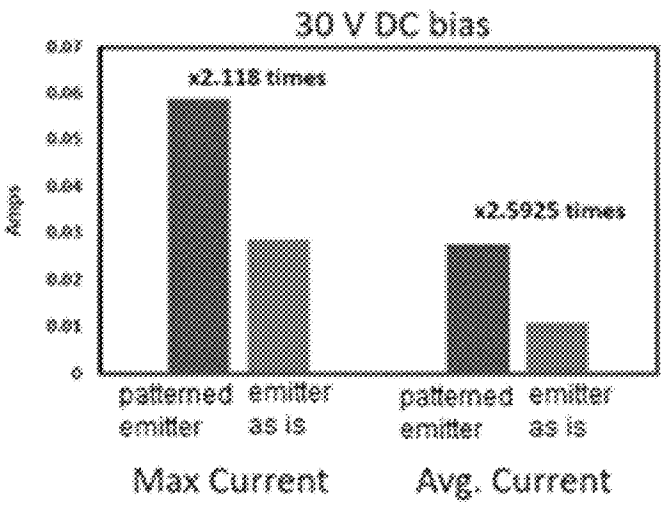
FIG. 7C is a graph of the currents emitted by an emitter in accordance with embodiments of the disclosure and an emitter prepared from tungsten foil as received under at 30 V bias.

The thermionic emission current of the tungsten metal foil emitters of Example 1 (as shown in FIG. 6C) was tested and compared against a polished, cold rolled, as-received tungsten foil representative of those found in conventional cesium thermionic converters. Each sample was tested in the same cesium atmosphere having a cesium vapor pressure of 5 torr, and heated to 1000° C. with the same propane blowtorch for 300 seconds. A positive DC bias was applied at 5 V, 15 V, and 30 V intervals to measure saturation emission current density. The net current output was measured using device provided by ATLAS ENERGY SYSTEMS, INC. Notably, the current measured was low, even with a 30 V bias, due to the gap between the emitter and collector being 6 inches. Nonetheless, as shown in FIGS. 7A-7C, the foil as prepared in Example 1 performed over 2 times (e.g., over 2.2 times or over 2.2 times) better than the polished, cold rolled tungsten foil in all three voltage ranges.

Therefore, Example 2 demonstrates that a thermionic converter including the emitter as described and prepared herein has improved performance as compared to a thermionic converter having a conventional emitter.

In addition, use of the "a" or "an" are employed to describe elements and components of the embodiments herein. This is done merely for convenience and to give a general sense of the description. This description should be read to include one or at least one and the singular also includes the plural unless it is obvious that it is meant otherwise.

Still further, the figures depict preferred embodiments of a computer system 100 for purposes of illustration only. One of ordinary skill in the art will readily recognize from the following discussion that alternative embodiments of the structures and methods illustrated herein may be employed without departing from the principles described herein.

Thus, while particular embodiments and applications have been illustrated and described, it is to be understood that the disclosed embodiments are not limited to the precise construction and components disclosed herein. Various modifications, changes and variations, which will be apparent to those skilled in the art, may be made in the arrangement, operation and details of the method and apparatus disclosed herein without departing from the spirit and scope defined in the appended claims.

What is claimed is:

1. A thermionic converter, comprising:

a collector;

an emitter;

a gap disposed between the collector and the emitter;

an electrical connection means connecting the collector and the emitter; and, cesium disposed in the gap adjacent the emitter, wherein:

the emitter comprises a cold worked metal substrate capable of emitting electrons when heated to temperatures of 800° C. or greater, the cold worked metal substrate is cold rolled in the direction of grains of a target crystallographic orientation having the lowest surface energy and highest bare work function;

the grains of the target crystallographic orientation are thermally grown such that the grains of the target crystallographic orientation represent at least 40% of the surface area of the metal substrate; and the grains of the target crystallographic orientation are etched to form a patterned surface, thereby increasing the surface area on a face of the grains.

2. The thermionic converter of claim 1, wherein the emitter and/or collector comprises one or more of iron, nickel, thorium, tungsten, niobium, tantalum, iridium, rhenium, molybdenum, mixtures, and alloys thereof.

3. The thermionic converter of claim 1, wherein the metal substrate is:

(a) tungsten or niobium, and the target grains have a or crystallographic orientation; or, (b) molybdenum, and the target grains have a [110] crystallographic orientation.

4. The thermionic converter of claim 1, wherein the surface area on a face of the etched target grains is at least 2 orders of magnitude greater than the surface area on a face of the heat grown target grains prior to etching.

5. The thermionic converter of claim 1, wherein the emitter and/or the collector is free of at least one of a thermionic coating and a dopant.

6. The thermionic converter of claim 1, wherein the emitter has a work function of about 1.5 eV to about 2.0 eV.

7. The thermionic converter of claim 1, wherein the collector has a work function of about 0.8 eV to about 1.2 eV.

8. The thermionic converter of claim 1, wherein the gap is about 20 μm to about 1500 μm.

9. The thermionic converter of claim 1, wherein the grains of the target crystallographic orientation represent about 40% to about 50% of the surface of the metal substrate.

10. The thermionic converter of claim 1, wherein the patterned surface comprises a surface structure comprised of a plurality of pyramidal structures having a fractal distribution, a plurality of hemispherical structures, and/or a plurality of single atomic steps.

* * * * *